US007946318B2

(12) United States Patent
Carroll

(10) Patent No.: US 7,946,318 B2
(45) Date of Patent: May 24, 2011

(54) VARIABLE DEPTH ROUTER AND BASE

(75) Inventor: Craig A. Carroll, Milan, TN (US)

(73) Assignee: Black & Decker Inc., Newark, DE (US)

( * ) Notice: Subject to any disclaimer, the term of this patent is extended or adjusted under 35 U.S.C. 154(b) by 358 days.

(21) Appl. No.: 12/130,100

(22) Filed: May 30, 2008

(65) Prior Publication Data

US 2008/0308188 A1 Dec. 18, 2008

Related U.S. Application Data

(60) Provisional application No. 60/943,486, filed on Jun. 12, 2007.

(51) Int. Cl.
*B27C 1/00* (2006.01)

(52) U.S. Cl. ..... 144/154.5; 409/178; 409/182; 144/136.95; 144/145.2

(58) Field of Classification Search ..... 409/182, 409/178, 218, 131, 197, 206; 144/136.95, 144/154.5, 135.2, 154, 145.2, 251.2, 253.1, 144/253.2

See application file for complete search history.

(56) References Cited

U.S. PATENT DOCUMENTS

| | | | | |
|---|---|---|---|---|
| 1,532,683 | A | | 4/1925 | Carter |
| 2,591,002 | A | | 4/1952 | Pedron |
| 2,630,152 | A | | 3/1953 | Turnbull |
| 2,842,173 | A | | 7/1958 | Turner et al. |
| 2,867,251 | A | | 1/1959 | Moretti et al. |
| 3,332,462 | A | | 7/1967 | Williams |
| 3,433,479 | A | | 3/1969 | Huck et al. |
| 3,581,787 | A | | 6/1971 | Bane |
| 4,244,406 | A | | 1/1981 | Stielper |
| 4,640,324 | A | | 2/1987 | Lounds |
| 4,679,606 | A | | 7/1987 | Bassett |
| 4,688,613 | A | | 8/1987 | Bassett |
| 4,693,656 | A | | 9/1987 | Guthrie |
| 4,787,794 | A | | 11/1988 | Guthrie |
| 4,946,323 | A | | 8/1990 | Kazama et al. |
| 5,074,724 | A | | 12/1991 | McCracken |
| 5,078,557 | A | * | 1/1992 | McCracken ..... 409/182 |
| 5,088,865 | A | | 2/1992 | Beth et al. |
| 5,167,477 | A | * | 12/1992 | Falkensson et al. ..... 409/178 |
| 5,176,479 | A | | 1/1993 | McCracken |
| 5,181,813 | A | | 1/1993 | McCracken |
| 5,188,492 | A | | 2/1993 | McCracken |
| 5,590,988 | A | | 1/1997 | Rusconi |
| 5,613,813 | A | | 3/1997 | Winchester et al. |

(Continued)

*Primary Examiner* — Dana Ross
*Assistant Examiner* — Jennifer Chiang
(74) *Attorney, Agent, or Firm* — Harness, Dickey & Pierce, P.L.C.

(57) ABSTRACT

A variable depth router and base assembly can include a ring-type, depth-adjustment mechanism. The base assembly can be a two-piece base wherein one piece is disposed inside the other. One of the pieces can include an annular lip or recess that can cooperate with levers on the adjustment ring to secure the router to the base assembly. The two-piece base assembly can facilitate the manufacture of the base assembly, can allow the use of different materials for different portions of the base assembly, and can provide a more economical base assembly. The use of differing materials can facilitate the using of more wear-resistant materials where needed while avoiding the costs of such materials in locations where it is not needed. The two-piece base assembly may allow various features to be economically incorporated into one of the pieces, thereby facilitating the manufacturing and assembly of the base assembly.

26 Claims, 10 Drawing Sheets

U.S. PATENT DOCUMENTS

| | | | | |
|---|---|---|---|---|
| 5,913,645 | A | 6/1999 | Coffee | |
| 6,050,759 | A | 4/2000 | Bone | |
| 6,089,331 | A * | 7/2000 | Christ | 173/216 |
| 6,679,658 | B2 * | 1/2004 | Landt | 409/182 |
| 6,725,892 | B2 * | 4/2004 | McDonald et al. | 144/136.95 |
| 6,726,414 | B2 * | 4/2004 | Pientka et al. | 409/182 |
| 6,779,954 | B2 | 8/2004 | Tomayko | |
| 6,835,030 | B2 * | 12/2004 | Pozgay et al. | 408/182 |
| 6,939,213 | B2 * | 9/2005 | Lovchik et al. | 451/360 |
| 7,232,280 | B2 * | 6/2007 | Bernardi et al. | 409/137 |

* cited by examiner

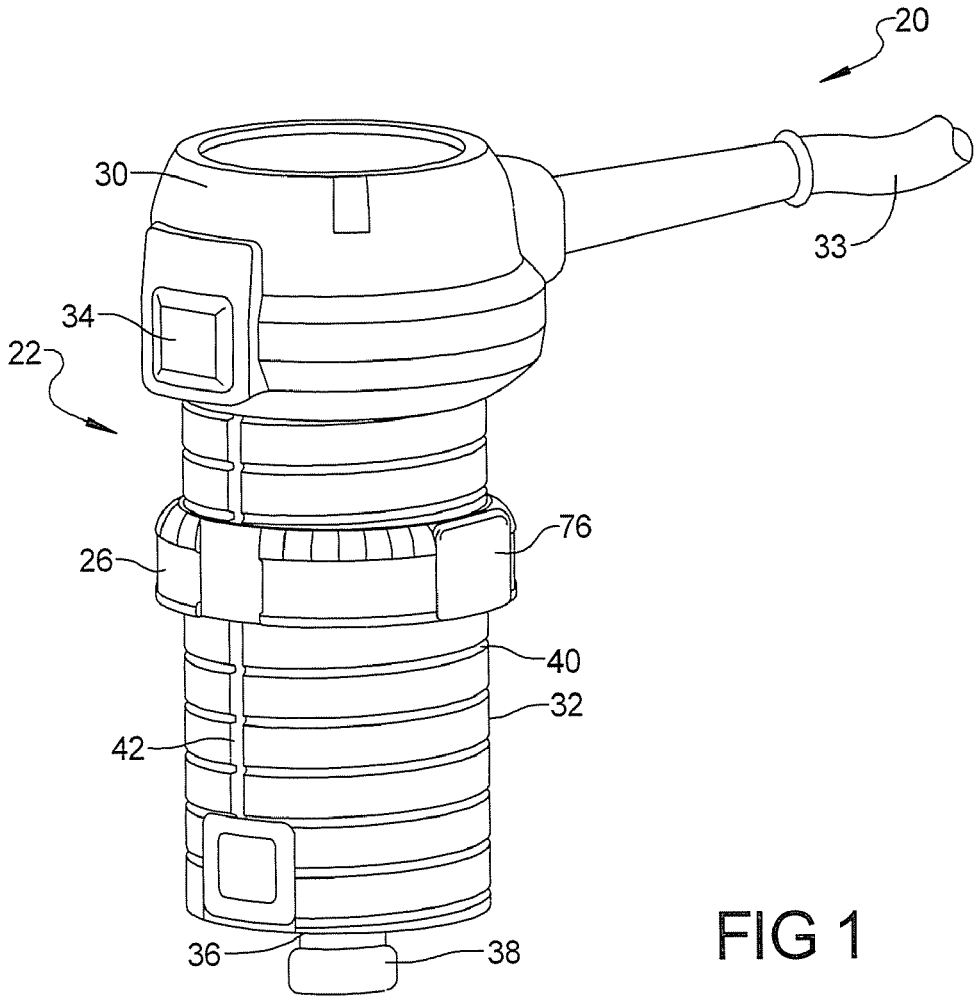
FIG 1
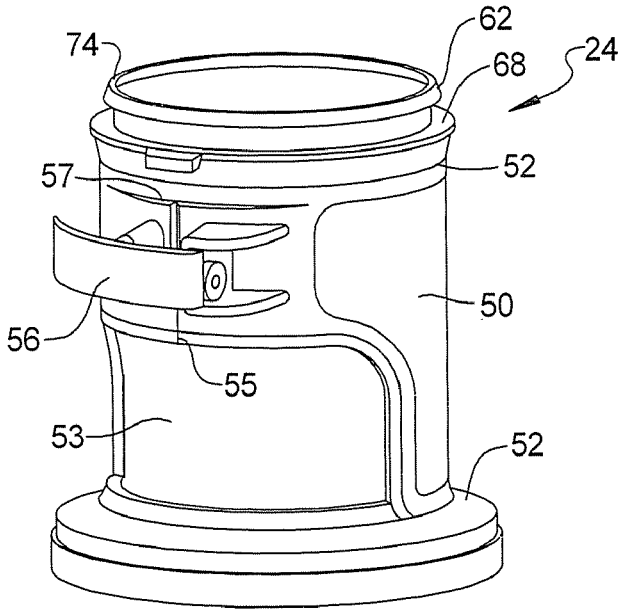

VARIABLE DEPTH ROUTER AND BASE

CROSS-REFERENCE TO RELATED APPLICATIONS

This application claims the benefit of U.S. Provisional Application No. 60/943,486, filed on Jun. 12, 2007. The disclosure of the above application is incorporated herein by reference.

FIELD

The present disclosure relates to routers and, more particularly, to a base assembly that can be used with a router to provide a variable depth.

BACKGROUND

The statements in this section merely provide background information related to the present teachings and may not constitute prior art.

Various types of power tools comprise a cutting tool or bit that is raised or lowered relative to a base that rests on or against the workpiece. Often the tool or bit is attached to the output shaft of a motor unit that can be vertically or axially moved relative to the base. Movement of the motor unit and attached tool bit relative to the base unit determines the depth of cut into the workpiece.

Routers, including some laminate trimmers, are constructed according to this basic design. The router bit is attached to the motor output spindle by means of a tool holder such as a collet or chuck and the bit projects through an opening in the base to contact the workpiece. The motor unit is mounted to the base by means that allow the operator to move the motor and bit axially relative to the base in order to determine the depth of cut of the bit. Router base and depth of cut systems fall into two commonly recognized categories. They are plunge-base routers and fixed-base routers (including so-called D-handle bases). Generally speaking, plunge routers comprise a generally planar base element, a motor unit, and a plurality of support columns on which the motor unit is vertically movably mounted above the base. Usually, the motor unit is biased upward or away from the base. Means are provided for finely adjusting the depth of cut and for locking the motor unit at the selected depth/height against the biasing force.

Fixed-base routers usually comprise a generally cylindrical base and a motor unit with a cylindrical housing portion. The cylindrical portion of the motor housing fits snugly but movably within an annulus of the cylindrical portion of the base with the motor spindle and router bit projecting downward beyond the lowest portion of the base. The cylindrical portion of the base often includes a longitudinal or axial cut or gap that permits the base diameter to expand or contract slightly under the force of a clamp mechanism that bridges the gap and that can be used to tighten the base onto the motor housing within. Means for adjusting the depth of cut by adjusting the vertical or axial position of the motor unit and bit within the base are also provided. The base clamp is loosened for adjusting the cutting depth and after the desired depth is set with the depth adjusting means the base clamp is tightened to lock the motor housing at the set position.

The typical base is made from a one-piece casting. The use of a one-piece casting requires that multiple surfaces be machined to accommodate the various components and features, such as the adjustment ring and the motor housing. Additionally, the multiple machined surfaces are required to allow precise positioning of the power tool relative to the base. The machining of multiple surfaces can be time-consuming, require intricate tooling, and/or increase the overall cost of the base. Thus, it would be advantageous to provide a base requiring less machined surfaces. Additionally, the use of a single, one-piece casting results in a base of a single material. In order to provide the desired strength for the base, the thickness of the base may be required to be large. This large size may make handling of the base and the tool awkward and/or inconvenient. Additionally, in the typical base, the anti-rotation feature is a separate component that is attached to the base. The use of a separate anti-rotation feature is an additional assembly step, can require an additional machining operation, and is an additional cost in the production of the base. Thus, it may be advantageous to provide a base requiring less machining operations and also which may be more convenient to use. Additionally, it would be advantageous if the cost of producing the base could be reduced.

SUMMARY

A router according to the present teachings can include a ring-type, depth-adjustment mechanism. The depth-adjustment mechanism can include an adjustment ring. The adjustment ring can include levers coupled thereto that can be used to secure the router to a fixed-base assembly. The base assembly can be a two-piece base assembly wherein one piece is disposed inside the other. One of the pieces can include an annular lip or recess that can cooperate with the lever on the adjustment ring to secure the router to the base assembly. The use of two separate pieces to form the base assembly can facilitate manufacture of the base assembly and attachment of the router thereto. The two-piece base assembly can also allow the use of a smaller diameter adjustment ring to increase user comfort. Additionally, the use of a two-piece base assembly can enable different materials to be utilized for different portions of the base assembly, thereby providing a more economical base assembly and facilitating the use of more wear-resistant materials where needed. Moreover, the use of a two-piece base assembly may allow various features to be economically incorporated into one of the pieces, thereby facilitating the manufacturing and assembly of the base assembly.

A portable router base assembly according to the present teachings includes a housing and a retaining ring. The housing has a foot, an upper portion, and an interior defined at least in part by an interior surface. The upper portion includes an upper surface. The housing interior is configured to receive a portion of a portable router. The interior surface includes a radially outwardly extending annular recess adjacent the upper surface. The retaining ring includes an interior, a generally cylindrical portion, and a top surface. The top surface at least partially defines an opening to the retaining ring interior. The cylindrical portion can be at least partially disposed in the annular recess of the housing. The retaining ring interior is configured to receive the portion of the portable router through the opening.

According to another aspect of the present teachings, a power tool assembly includes a portable router and a fixed-base assembly. The portable router includes a head portion, a generally cylindrical portion, a motor unit, and a spindle operable to receive a working tool. The fixed-base assembly is operable to receive the portable router and support the portable router in a desired axial position relative to a working surface. The fixed-base assembly includes a housing and a retaining ring. The housing has a foot, an upper portion, and an interior defined at least in part by an interior surface. The upper portion includes an upper surface. The housing interior receives the cylindrical portion of the portable router. The interior surface includes a radially outwardly extending annular recess adjacent the upper surface. The retaining ring includes an interior, a generally cylindrical portion, and a top surface. The top surface at least partially defines an opening to the retaining ring interior. The retaining ring cylindrical portion is at least partially disposed in the annular recess of the housing. The retaining ring interior is configured to receive the cylindrical portion of the portable router through the opening.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present teachings in any way.

FIG. 1 is an exploded view of a router disengaged from a fixed-base assembly according to the present teachings;

DETAILED DESCRIPTION

Figure 3:
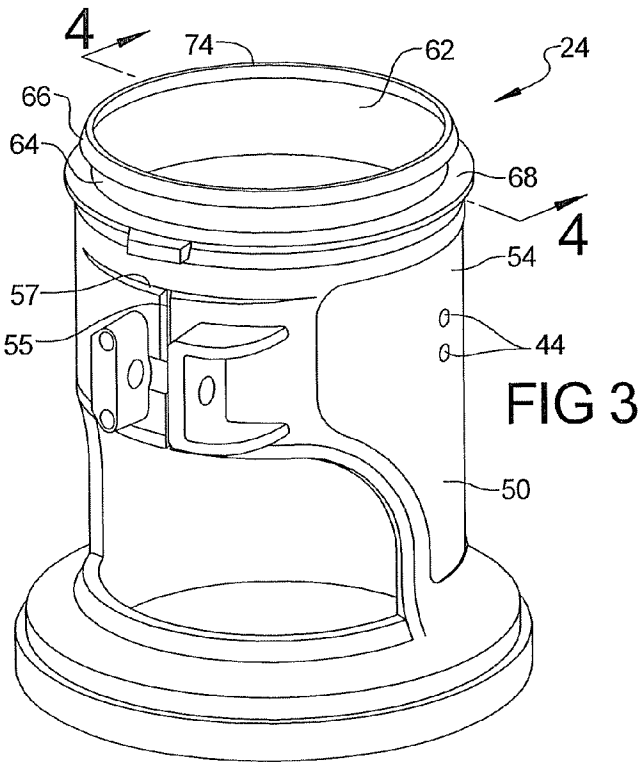
FIG. 3 is a perspective view of the fixed-base assembly according to the present teachings.
Figure 2:
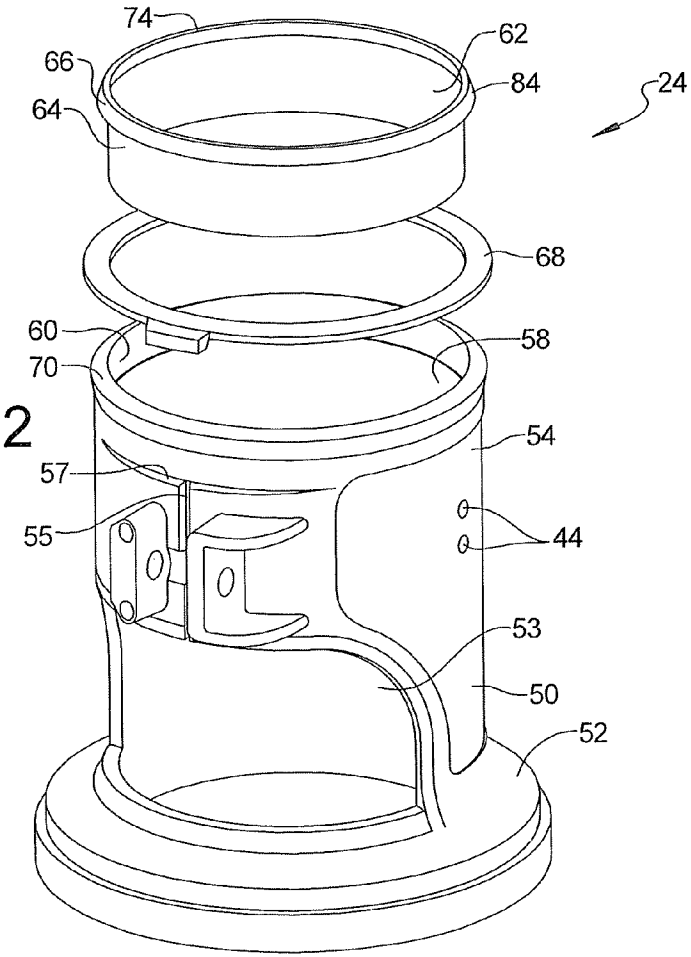
FIG. 2 is an exploded view of the fixed-base assembly according to the present teachings.

The following description is merely exemplary in nature and is not intended to limit the present teachings, application, or uses. It should be understood that throughout the drawings, corresponding reference numerals indicate like or corresponding parts and features (e.g., 20, 120, 220, etc.).

The present teachings provide an improved base assembly that can be used with a power tool having a depth-adjustment mechanism and which can be quickly coupled and de-coupled thereto for use with other implements. While shown throughout the drawings in a fixed-base router, those skilled in the art will appreciate that the present teachings are not so limited in scope. In this regard, the present teachings will be understood to be readily adaptable for use in other tools incorporating motor housings axially moveable in a base assembly by means of a rotatable ring element threadably engaged with the motor housing.

Referring now to FIG. 1, a first embodiment of a power tool 20 according to the present teachings is shown. Power tool 20 is illustrated in the form of a router and can include a motor unit 22, a fixed-base assembly 24, and a depth-of-cut adjustment ring 26.

Motor unit 22 can include an electric motor (not shown) within a housing comprising a head portion 30 and a cylindrical portion 32. The motor can be powered through a cord 33 and controlled by a switch 34. In some embodiments, the motor may be powered by a battery pack. A motor spindle 36 can project from the bottom of motor unit 22. A collet 38 can be attached to the end of spindle 36. Collet 38 can hold cutting tools, such as router bits, which can then rotate with rotation of spindle 36. Cylindrical portion 32 can include threads 40 that engage with complementary threads 41 (FIG. 6) on adjustment ring 26. Cylindrical portion 32 can also include an exterior and axially extending slot 42 that can engage with projecting features 44 (FIGS. 4 and 6) in the interior of housing 50 to prevent rotation between motor unit 22 and base assembly 24. Projecting features 44, as known in the art, can each include a head portion 46 and a stem portion 48 and can extend through a pair of openings 49 in housing 50. Openings 49 can be machined in housing 50 and projecting features 44 can be subsequently inserted therein. Head portions 46 project radially inwardly into the interior of housing 50 and engage with slot 42 to prevent relative rotation between motor unit 22 and base assembly 24. Projecting features 44 can be retained in openings 49 in a variety of manners. By way of non-limiting example, projecting features 44 can be press fit into openings 49 or can include a knurled surface that can engage with openings 49 to retain projecting features 44 therein.

Referring now to FIGS. 1-4, base assembly 24 can include a generally axially extending cylindrical housing 50 with a flared foot 52 that forms a flat planar surface for travel along a workpiece. Housing 50 can include a large aperture 53 therein that allows visibility of the cutting tool coupled to collet 38. A section 51 of an upper portion 54 of housing 50 can include an axial gap 55 and a horizontal slot 57 that permits expansion and contraction of section 51 of upper portion 54 under the influence of a clamp assembly 56, which can be constructed and can operate in a well-known manner. Upper portion 54 can form a generally cylindrical interior surface 58 which can be sized to accommodate cylindrical portion 32 of motor unit 22 such that when clamp assembly 56 is opened/released motor unit 22 may slide easily within base assembly 24, and when clamp assembly 56 is closed/engaged can hold cylindrical portion 32 of motor unit 22 firmly and non-slideably therein. Housing 50 can be made from a variety of materials, as known in the art. By way of non-limiting example, housing 50 can be diecast aluminum and diecast magnesium.

Interior surface 58 of upper portion 54 can include an annular radially outwardly extending recess 60 that can be machined therein and dimensioned to receive a retaining ring 62. Recess 60 can be above section 51 and can be dimensioned to allow retaining ring 62 to be press fit into housing 50 for retention therein. Retaining ring 62 can be a formed component, and can include a top surface or edge 74, a first generally cylindrical portion 64, and an annular radially outwardly extending lip 66 above cylindrical portion 64. The inner diameter of retaining ring 62 can be dimensioned to allow cylindrical portion 32 of motor unit 22 to move relatively freely therein. With this configuration, retaining ring 62 does not constrain movement of motor unit 22 regardless of the position of clamp assembly 56. Rather, the constraining of motor unit 22 is performed by housing 50 and clamp assembly 56.

Figure 6:
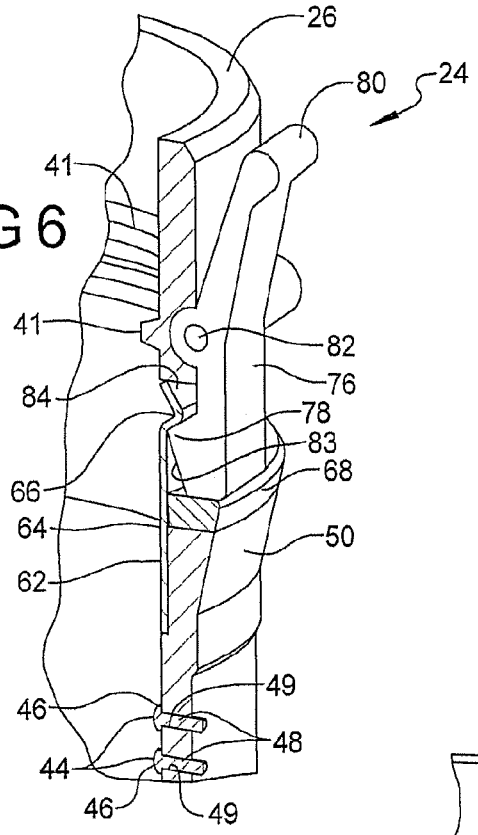
FIG 6 (PRIOR ART)
FIG. 6 is a fragmented cross-sectional view of the fixed-base assembly of FIG. 4 with a depth-adjustment ring and the associated lever coupled thereto disposed on the fixed-base assembly according to the present teachings.

A depth-indicator ring 68 can be disposed on a top surface 70 of housing 50 and be retained thereon by lip 66 of retaining ring 62. Top surface 70 may be an as formed surface or a machined surface. In the preferred embodiment, top surface 70 provides a support for depth-indicator ring 68 and does not need to be a machined surface. In other embodiments, top surface 70 may be utilized to provide a precise support for adjustment ring 26. When this is the case, top surface 70 can be a machined surface to thereby ensure the top surface 70 is parallel with the flat planar bottom surface of foot 52. This machining operation of top surface 70 can allow precise positioning of router 20 and control of the depth of the cut. In the embodiment shown in FIGS. 1-4, 6, and 8, top surface 74 of retaining ring 62 provides vertical support for motor unit 22 via adjustment ring 26. Specifically, as shown in FIG. 6, adjustment ring 26 rests on top surface 74 which thereby provides vertical support for adjustment ring 26 which in turn supplies vertical support for motor unit 22. When this is the case, top surface 74 may be precisely positioned relative to housing 50 to ensure that top surface 74 is parallel with the flat planar bottom surface of foot 52. This can be achieved by proper dimensioning of recess 60 and of retaining ring 62.

Retaining ring 62 can be a formed component that can be easily manufactured and can be made from a variety of materials. By way of non-limiting example, retaining ring 62 can be hardened steel and stainless steel. Retaining ring 62 can be made by a variety of processes. By way of non-limiting example, retaining ring 62 can be stamped, deep-drawn, or made in a metal spinning process. Additionally, retaining ring 62 can be formed with steel prior to the steel being hardened.

Recess 60 in interior surface 58 of housing 50 can be easily formed therein through a simple machining operation. Recess 60 and top surface 70 (when machined) may be formed in a single machining operation. Upper portion 54 and retaining ring 62 facilitate the selective attachment of motor unit 22 to base assembly 24, as described below. The features to selectively retain motor unit 22 to base assembly 24 can be easily and economically produced by machining a single surface of the interior surface 58 of housing 50 to form recess 60, and optionally top surface 70, and through the simple forming of retaining ring 62. Housing 50 and retaining ring 62 can be different materials and these different materials can provide advantages over the typical fixed base construction as described below.

Referring now to FIG. 6, adjustment ring 26 is shown coupled to base assembly 24 without motor unit 22 upon which adjustment ring 26 is normally disposed. Adjustment ring 26 is supported by top surface 74 and can include a pair of levers 76 (only one shown) that are pivotally coupled to an exterior of adjustment ring 26. Levers 76 can be equally spaced about the periphery of adjustment ring 26. Lever 76 can include a retaining tang 78 on one end thereof that extends radially inwardly relative to adjustment ring 26. Lever 76 can be biased by a spring (not shown) so that tang 78 is in its radially innermost position and can engage with the underside of lip 66, as shown in FIG. 6, to retain motor unit 22 to base assembly 24. Pushing radially inwardly on upper end 80 of lever 76 causes lever 76 to pivot about pivot 82 and tang 78 to move radially outwardly so that lever 76 disengages with lip 66 of retaining ring 62 and motor unit 22 (along with adjustment ring 26) can be removed from base assembly 24. When lever 76 is in its biased position, tang 78 engages with lip 66 of retaining ring 62 to prevent removal of motor unit 22 (along with adjustment ring 26) from base assembly 24.

Adjustment ring 26 includes threads 41 that engage with threads 40 on cylindrical portion 32 of motor unit 22. The engagement between threads 41 of adjustment ring 26 and threads 40 of motor unit 22 allows motor unit 22 to be moved axially relative to base assembly 24 by relative rotation therebetween so that the depth of the cutting tool attached to collet 38 can be adjusted. Specifically, adjustment ring 26 can be rotated relative to housing 50 while motor unit 22 remains rotationally stationary relative to housing 50 due to the interaction of slot 42 with projecting features 44. Levers 76 do not prevent the rotation of adjustment ring 26 relative to housing 50. In this manner, adjustment ring 26 can be rotated to adjust the depth of cut without requiring a user to engage or disengage levers 76. When a desired cutting depth has been achieved, clamp assembly 56 of housing 50 can be closed/engaged to thereby secure motor unit 22 to housing 50. When motor unit 22 is secured to housing 50, rotation of adjustment ring 26 is inhibited due to the interaction of threads 40 of motor unit 22 and threads 41 of adjustment ring 26.

Thus, in router 20 according to the present teachings motor unit 22 can be easily removed from and secured to base assembly 24. Clamp assembly 56 of base assembly 24 can be opened/disengaged and motor unit 22 can be axially positioned within the interior of base assembly 24. The position of adjustment ring 26 on cylindrical portion 32 determines the axial position of motor unit 22 on base assembly 24. Levers 76 on adjustment ring 26 can automatically engage with lip 66 with the complementary sloping surfaces 83, 84 of tangs 78 and lip 66, respectively, causing levers 76 to pivot about pivot 82 as tangs 78 slip over lip 66 and automatically secure motor unit 22 to base assembly 24. Adjustment ring 26 can be rotated relative to base assembly 24 to position motor unit 22 in a desired axial position. When in the desired axial position, clamp assembly 56 can be closed/engaged to thereby secure motor unit 22 within housing 50 with interior surface 58 of upper portion 54 diminishing its diameter and securing itself to cylindrical portion 32 of motor unit 22. Router 20 can then be operated as a fixed-base router.

To remove router 20 from base assembly 24, clamp assembly 56 can be opened/disengaged and upper ends 80 of levers 76 depressed radially inwardly so that tangs 78 extends radially outwardly beyond lip 66. Motor unit 22 (along with adjustment ring 26) can then be lifted axially relative to base assembly 24 and removed therefrom. Router 20 can then be used with other attachment features, such as a plunge base (not shown).

Figure 5:
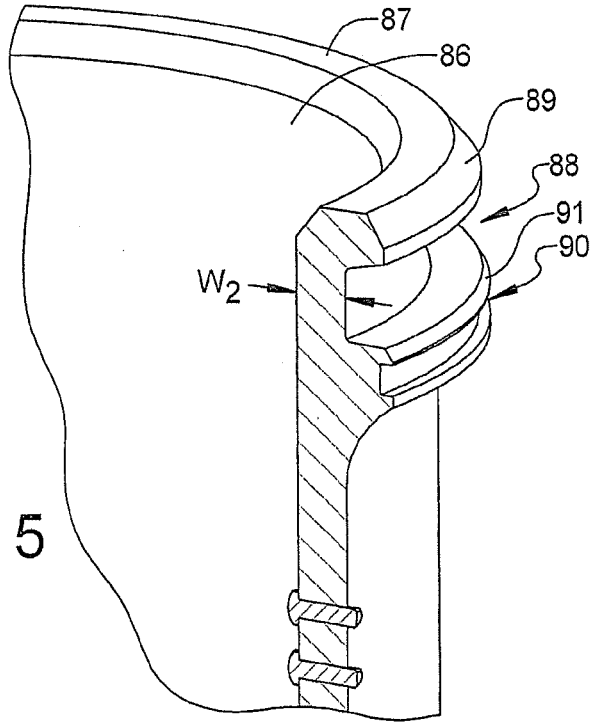
(PRIOR ART) FIG 5
FIG. 5 is a fragmented cross-sectional view similar to the view of FIG. 4 of a conventional fixed base configured to accommodate the router of FIG. 1.
Figure 7:
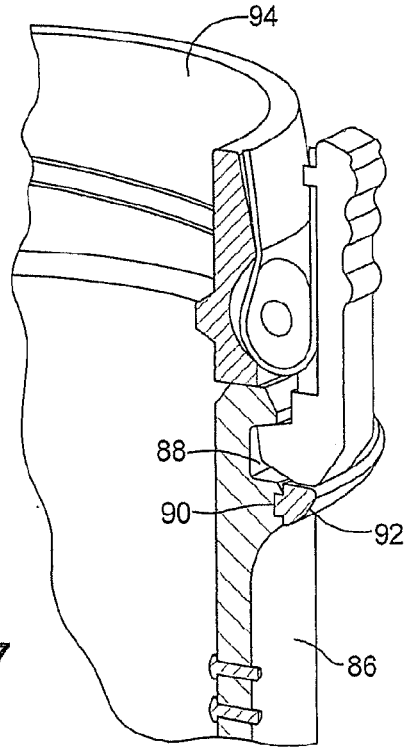
FIG. 7 is a fragmented cross-sectional view of the conventional fixed base of FIG. 5 with a depth-adjustment ring and the associated lever coupled thereto disposed on the conventional fixed base.

The base assembly 24 according to the present teachings may be more easily and economically produced versus a conventional base. For example, as shown in FIGS. 5 and 7, a conventional housing 86, in addition to the machining required to form the flat planar bottom surface, can require the machining of multiple surfaces to provide the same function as retaining ring 62 and housing 50. In particular, housing 86 can require the machining of a top surface 87 along with a first exterior annular recess 88 and chamfer 89 to allow the tangs of the levers to engage therewith. Additionally, a second annular recess 90 and chamfer 91 may be required to be machined therein to hold a depth-indicator ring 92. These additional machined surfaces of a conventional housing 86 can increase the cost of the tooling and the time to machine housing 86 over that of base assembly 24. Additionally, these multiple machined surfaces may require multiple setups, thereby further increasing the time required to produce a conventional housing 86. This is in direct contrast with the base assembly 24 according to the present teachings which may have a single machined recess 60 (excluding the machined flat planar bottom surface which is common to both housing 50 and housing 86) which may be machined with a single tooling and setup. Additionally, the tooling required to provide recess 60 is of a simple design and does not require complex or intricate cutting details. Even in the event that top surface 70 is also a machined surface, top surface 70 can be machined simultaneously with recess 60 and can still utilize a single tooling and setup. Additionally, the tooling that will be used to simultaneously machine both top surface 70 and recess 60 would still be of a simple design and would not require complex or intricate cutting details. Thus, the base assembly 24 according to the present teachings may be more easily and economically produced versus a conventional base.

Figure 4:
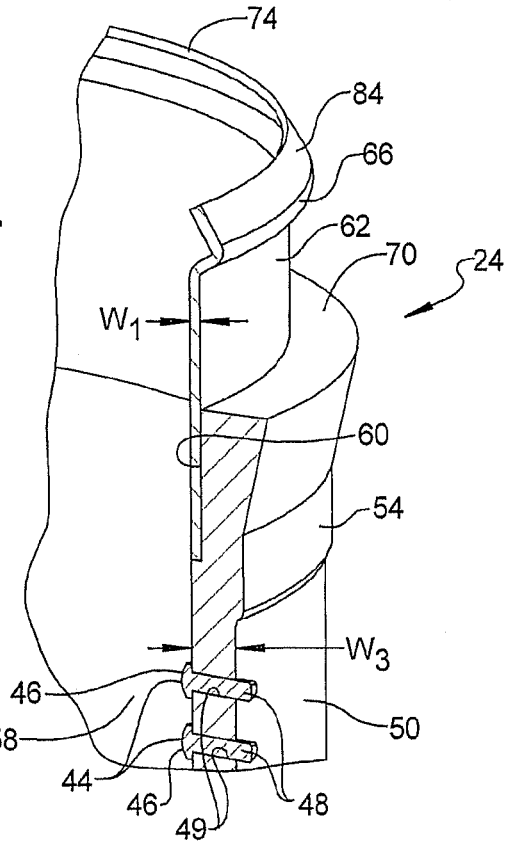
FIG. 4 is a fragmented cross-sectional view of the fixed-base assembly of FIG. 3 along line 4-4 with the depth-indicator ring removed.
Figure 9:
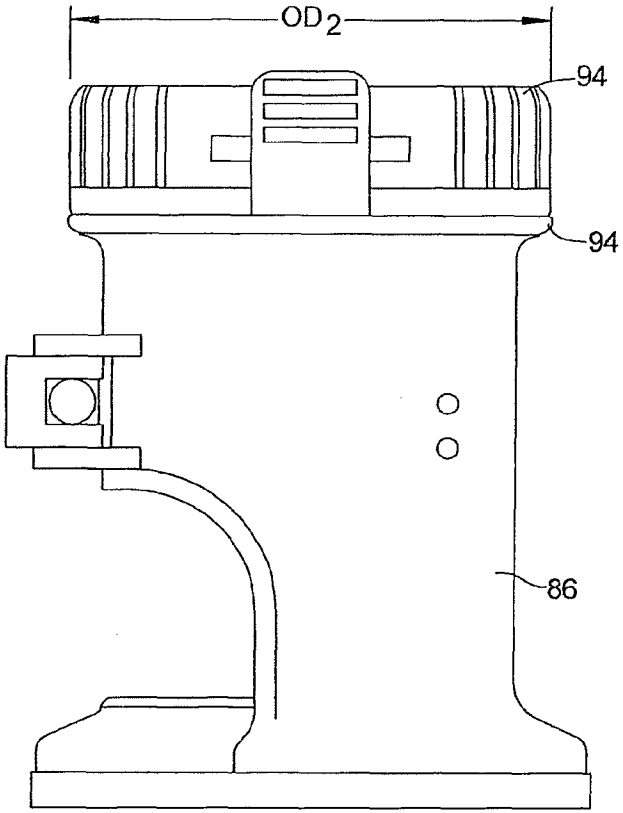
FIG 9 (PRIOR ART)
FIG. 9 is a plan view similar to the view of FIG. 8 of a conventional fixed base with the depth-adjustment ring coupled thereto.
Figure 8:
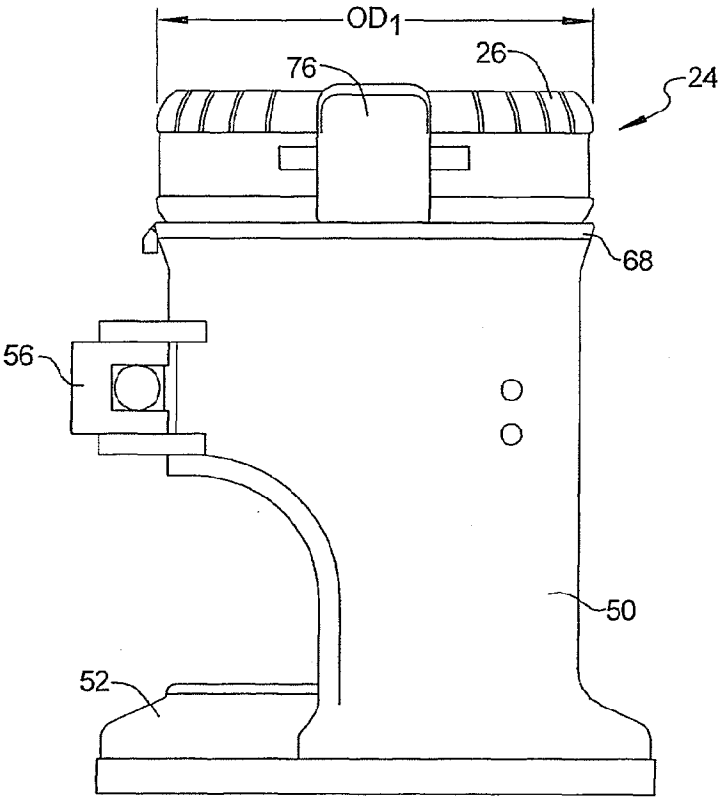
FIG. 8 is a plan view of the fixed-base assembly according to the present teachings with the depth-adjustment ring coupled thereto.

The base assembly 24 according to the present teachings may allow for a smaller base assembly and/or adjustment ring versus a conventional base. The smaller size can advantageously facilitate handling and control of router 20 and may provide a more pleasing experience for the user. Specifically, as shown in FIG. 5, the portion of housing 86 within which first annular recess 88 is machined must have a sufficient thickness/width to adequately retain motor unit 22 to housing 86. Depending upon the strength and machinability constraints of the material of which housing 86 is formed, the required thickness of the housing at first annular recess 88 can vary. In contrast, as can be seen when comparing FIG. 4 to FIG. 5, a base assembly 24 according to the present teachings can use two different materials for housing 50 and retaining ring 62. As a result, retaining ring 62 can be chosen from a material that allows for a much smaller thickness/width than would be required if machining the retaining ring recess within housing 50. That is, as shown in FIG. 4, the width $W_1$ of retaining ring 62 can be substantially smaller than the width $W_2$ of a base having a conventional housing 86. Width $W_1$ of retaining ring 62 can also be less than the width $W_3$ of upper portion 54 of housing 50. The reduced width $W_1$ of retaining ring 62 can allow the use of an adjustment ring 26 having a smaller outer diameter. For example, as shown in FIGS. 8 and 9, adjustment ring 26 used with a base assembly 24 according to the present teachings can have an outer diameter $OD_1$ that is substantially less than the outer diameter $OD_2$ of an adjustment ring 94 on a conventional base with housing 86. The reduced outer diameter $OD_1$ of adjustment ring 26 can aid user comfort and allow a user to more easily grip adjustment ring 26 during rotation to adjust the axial position of motor unit 22 relative to base assembly 24. Thus, base assembly 24 according to the present teachings may allow for a smaller base assembly and/or adjustment ring versus a conventional base.

An additional advantage of a base assembly 24 according to the present teachings is the ability to use differing materials having differing properties for housing 50 and retaining ring 62. For example, retaining ring 62 can be made from a more durable material while housing 50 can be made from a less durable material. The use of a more durable material for retaining ring 62 may allow for the reduced width $W_1$ discussed above relative to a conventional base with housing 86. Additionally, the use of a more durable material may provide a better tactile sensation or feel when using router 20 throughout its lifespan. For example, if a conventional base housing 86 is dropped or damaged, the top surface 87 may become marred, deformed, or dented. As a result, when a user is rotating the adjustment ring 94 along top surface 87, these bumps or deformations may provide a non-pleasing tactile sensation. Additionally, these deformations may also affect the axial movement of motor unit 22 relative to housing 86 such that the same precision in adjustment may not be achieved. In contrast, the use of a more durable material for retaining ring 62 may allow base assembly 24 to continue to provide a pleasing tactile sensation and precise control of the axial position when subjected to the same types of potentially damage-causing incidents. Thus, a base assembly 24 according to the present teachings in using different materials having differing properties for housing 50 and retaining ring 62 may provide a more durable base assembly 24 which can increase the longevity of base assembly 24 and/or provide a more enjoyable tactile experience by a user.

Yet another advantage of a base assembly 24 according to the present teachings using differing materials is that the cost may be reduced. For example, differing materials having differing costs can be used for housing 50 and retaining ring 62. For example, retaining ring 62 may be made from a first material having a first cost while housing 50 is made from a second material having a second cost. The second material may be less expensive than that which would be required to form a housing 86 of a conventional base. Because the differing parts of base assembly 24 may provide differing functions, different material requirements are necessary for retaining ring 62 and housing 50. As a result, it may be possible to select more economical materials for housing 50 than is available when selecting material for housing 86 of a conventional base. Thus, the use of different materials may allow for a more economical selection of materials over a conventional base by allowing different materials for housing 50 and retaining ring 62.

Figure 10:
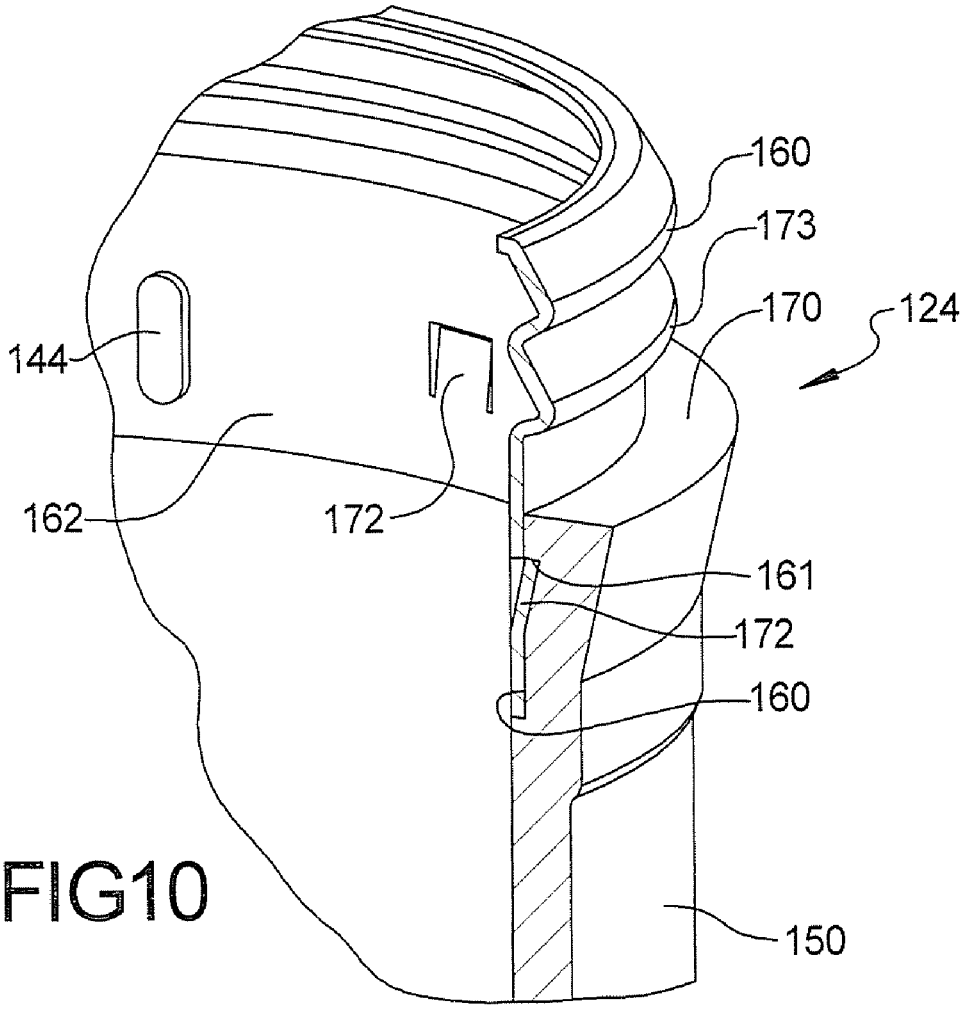
FIG. 10 is a fragmented cross-sectional view similar to that shown in FIG. 4 of an alternate embodiment of the fixed-base assembly according to the present teachings.

Referring now to FIG. 10, an alternate embodiment of the fixed-base assembly 124 according to the present teachings is shown. Base assembly 124 is similar to base assembly 24 discussed above. As such, only the main differences are described herein. Base assembly 124 advantageously incorporates an anti-rotation feature into retaining ring 162. In particular, a radially inwardly extending projecting feature 144 is integral with retaining ring 162. Projecting feature 144 extends axially along retaining ring 162 and is dimensioned to be received in slot 42 of motor unit 22. Projecting feature 144 can be easily formed in retaining ring 162 during the forming thereof. By way of non-limiting example, projecting feature 144 can be formed in retaining ring 162 during a stamping, deep-drawing, or metal-spinning process. It should be appreciated that in some embodiments projecting feature 144 can be formed in retaining ring 162 subsequent to the forming of retaining ring 162. The forming of projecting feature 144 integral with retaining ring 162 eliminates the need for separate components that are utilized to provide the anti-rotation feature, as discussed above with reference to base assembly 24 and as utilized in conventional fixed-base housings. The forming of projecting feature 144 as an integral feature of retaining ring 162 also eliminates the need to machine openings 49 through housing 150. Thus, the use of a projecting feature 144 that is integral with retaining ring 162 can advantageously eliminate a separate machining operation for housing 150, can eliminate the need for separate and distinct anti-rotation features, and can be economically formed during the forming of retaining ring 162.

Base assembly 124 may also include axial retaining features 172 that inhibit removing of retaining ring 162 from housing 150. In particular, axial retaining features 172 can include a plurality of tabs in retaining ring 162 that extend radially outwardly as they extend axially upwardly. Axial retaining features 172 can be spaced apart along retaining ring 162. Recess 160 can include a shoulder 161 that extends radially inwardly. Recess 160 is axially dimensioned such that shoulder 161 engages with axial retaining features 172 and axially retains retaining ring 162 in housing 150. Engagement between axial retaining features 172 and shoulder 161 inhibit removal of retaining ring 162 from housing 150. Axial retaining features 172 can be used in conjunction with press fitting of retaining ring 162 into housing 150. In some embodiments, it may be possible to utilize axial retaining features 172 as the sole means of axially retaining retaining ring 162 in housing 150. The use of axial retaining features 172 can facilitate the precise positioning of router 20 on base assembly 124 versus that of press fitting the retaining ring. Specifically, the manufacturing tolerances of forming recess 160 and the axial length of retaining ring 162 and axial retaining features 172 are more easily met than when also trying to meet the tolerances required for press fitting the retaining ring into the housing.

Axial retaining features 172 can be easily manufactured during the forming of retaining ring 162. By way of non-limiting example, axial retaining features 172 can be formed during a stamping, deep-drawing, or metal-spinning process when forming retaining ring 162. It should be appreciated that in some embodiments axial retaining features 172 can be formed in retaining ring 162 subsequent to the forming of retaining ring 162. Thus, a base assembly 124 according to the present teachings can advantageously include axial retaining features to facilitate retaining of retaining ring 162 and housing 150.

Base assembly 124 may include a second lip 173 on retaining ring 162. Second lip 173 is below first lip 166 and can be used to retain a depth-indicator ring 68 thereon. In particular, the depth-indicator ring 68 can be positioned between top surface 170 of housing 150 and second lip 173 of retaining ring 162. The use of second lip 173 can prevent/inhibit inadvertent removal of a depth-indicator ring 68 from base assembly 124.

Figure 11:
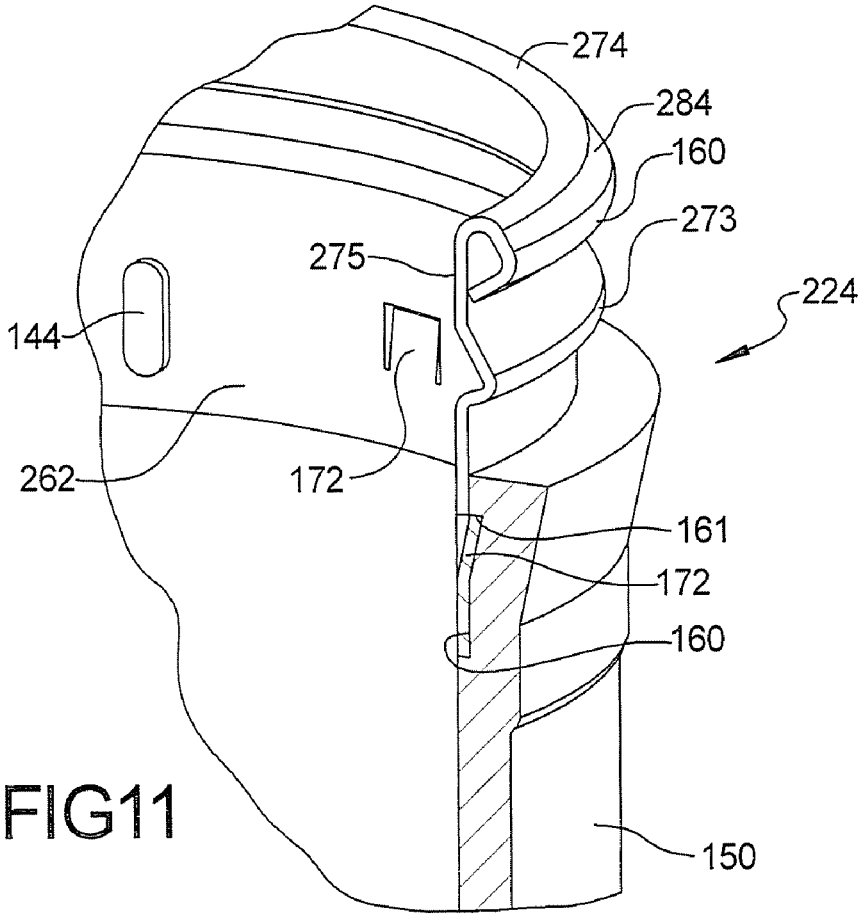
FIG. 11 is a fragmented cross-sectional view similar to that shown in FIG. 4 of another alternate embodiment of the fixed-base assembly according to the present teachings.

Referring now to FIG. 11, another alternate embodiment of a fixed-base assembly 224 according to the present teachings is shown. Base assembly 224 is similar to base assembly 124 discussed above. As such, only the main differences therebetween are described herein. Base assembly 224 can include a retaining ring 262 with a top surface 274 that facilitates the insertion of motor unit 22 therein. Specifically, top surface 274 can be rounded and can be formed by the juncture of sloping surface 284 and an inner wall 275 of retaining ring 262. Inner wall 275 extends axially along the inner surface of retaining ring 262 between top surface 274 and the inner surface of second lip 273. Sloping surface 284, top surface 274, and inner wall 275 may provide a continuous surface that is rounded on the top thereof and can taper slightly radially inwardly. As a result, the opening to retaining ring 262 can facilitate the insertion of cylindrical portion 32 of motor unit 22 therein. Thus, a base assembly 224 according to the present teachings can advantageously incorporate features in retaining ring 262 that facilitate the insertion of motor unit 22 therein. Additionally, the use of rounded top surface 274 avoids any abrupt edges or features that may inhibit the insertion of cylindrical portion 32 of motor unit 22 into base assembly 224.

Figure 12:
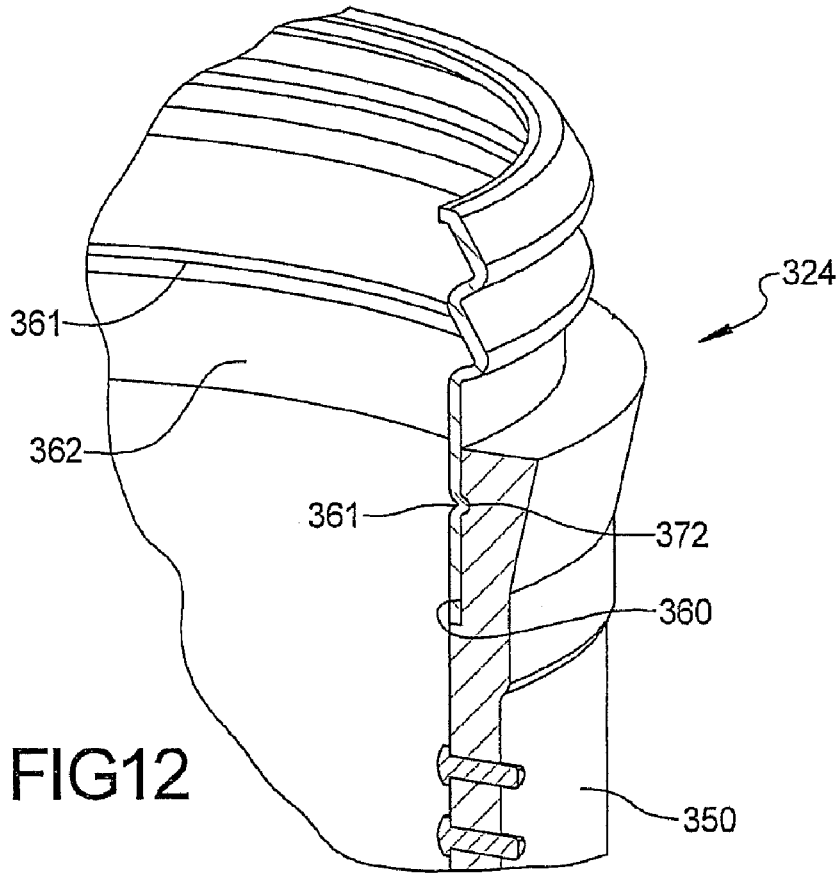
FIG. 12 is a fragmented cross-sectional view similar to that shown in FIG. 4 of still another alternate embodiment of the fixed-base assembly according to the present teachings.

Referring now to FIG. 12, another alternate embodiment of a fixed-base assembly 324 according to the present teachings is shown. Base assembly 324 is similar to fixed-base assembly 24 and 124 discussed above. As such, only the main differences are described herein. Base assembly 324 utilizes a different axial retaining feature 372. In this embodiment, axial retaining feature 372 is a radially outwardly extending projection that circumscribes the periphery of retaining ring 362. In this configuration, axial retaining feature 372 is easily formed in retaining ring 362 during the forming thereof. By way of non-limiting example, axial retaining feature 372 can be formed during a stamping, deep-drawing, or metal-spinning process when forming retaining ring 362. To accommodate axial retaining feature 372, recess 360 includes an annular groove 361 that extends radially outwardly within recess 360. Groove 361 is complementary to axial retaining feature 372.

Retaining ring 362 is positioned in the interior of housing 350 through the top and axial retaining feature 372 snaps into groove 361 in recess 360. The engagement of axial retaining feature 372 in groove 361 inhibits removal of retaining ring 362 from housing 350.

Groove 361 can be easily formed in housing 350 during the forming of recess 360. In particular, the tooling utilized to form recess 360 can include an additional feature that also forms groove 361 when machining recess 360.

While axial retaining feature 372 is shown and described as being a continuous axial retaining feature 372 that circumscribes the periphery of retaining ring 362, it should be appreciated that axial retaining feature 372 can be comprised of a plurality of discrete segments that are spaced apart along the periphery and engaged with groove 361.

Thus, a base assembly 324 according to the present teachings can utilize an annular groove 361 and a radially outwardly projecting axial retaining feature 372 to secure retaining ring 362 and housing 350. The use of axial retaining feature 372 and groove 361 can be easily constructed in retaining ring 362 and housing 350.

Figure 13:
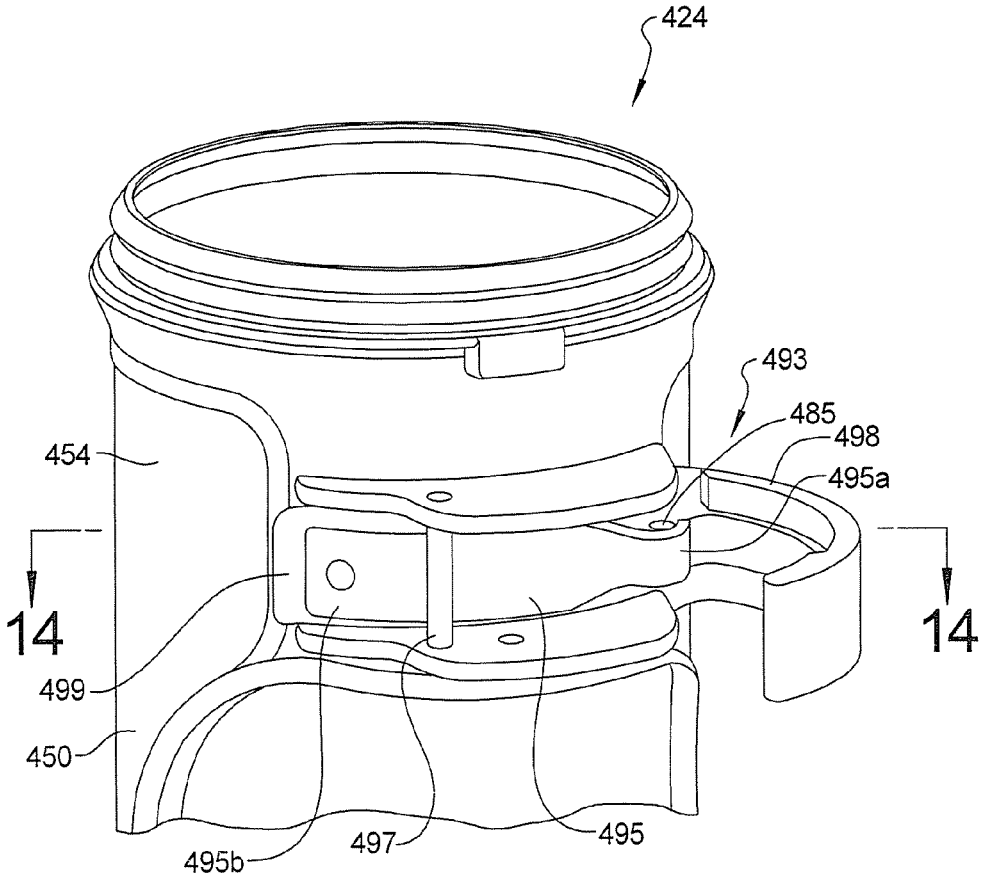
FIG. 13 is a fragmented perspective view of yet another alternate embodiment of a fixed-base assembly according to the present teachings.
Figure 14:
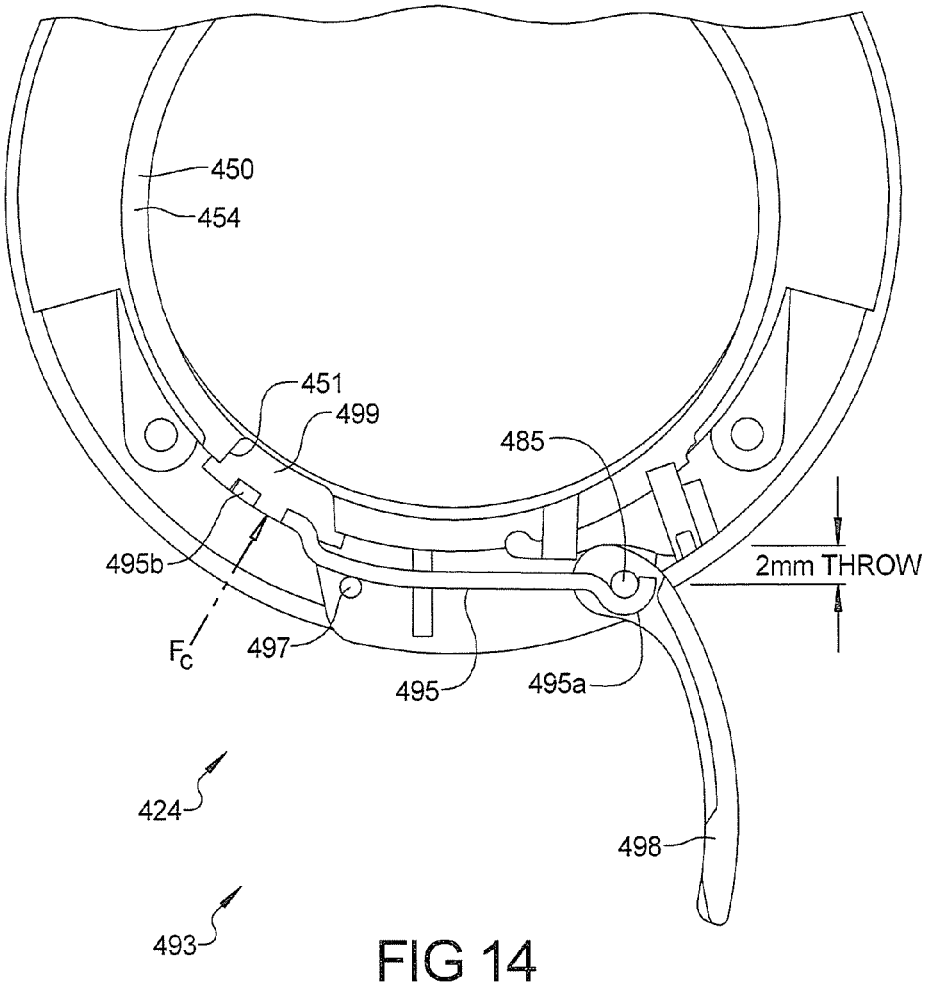
FIG. 14 is a cross-sectional view of the fixed-base assembly of FIG. 13 along line 14-14.

Referring now to FIGS. 13 and 14, a fixed-base assembly 424 according to still another embodiment of the present teachings is shown. Base assembly 424 is similar to base assembly 24 discussed above. As such, only the main differences are described herein. Base assembly 424 incorporates a different type of clamping assembly to secure router 20 within base assembly 424. Specifically, base assembly 424 includes a clamping assembly 493 that eliminates the need for gap 55 and slot 57 in upper portion 454. Clamping assembly 493 includes a clamp spring 495, a pivot pin 497, a clamp lever 498, and, optionally, a clamp pad 499. Clamp lever 498 has a cammed surface and is engaged with one end 495*a* of clamp spring 495, while clamp pad 499 is associated with the other end 495*b* of clamp spring 495. Clamp pad 499 extends through an opening 451 in upper portion 454 of housing 450.

Clamp pad 499 can move radially inwardly and outwardly with the movement of clamp lever 498 through clamp spring 495. This movement allows clamping assembly 493 to secure router 20 in base assembly 424. Specifically, clamp lever 498 can be rotated about a pivot 485 between open and closed positions. When in the closed position, clamp lever 498 is adjacent housing 450 and causes end 495*a* of spring 495 to move radially outwardly which in turn causes end 495*b* to move radially inwardly as clamp spring 495 pivots about pivot pin 497. When this is the case, clamp pad 499 exerts a clamping force Fc (as shown in phantom in FIG. 14) which clamps router 20 in a fixed position relative to base assembly 424. When clamp lever 498 is rotated away from housing 450, as shown in FIGS. 13 and 14, end 495*a* moves radially inwardly, allowing end 495*b* to move radially outwardly such that clamp pad 499 no longer exerts force Fc against router 20. Router 20 can then removed from base assembly 424 or have its axial position adjusted relative thereto through the adjustment ring.

Thus, in base assembly 424, a clamping assembly 493 is utilized to selectively secure router 20 in base assembly 424. Clamping assembly 493 can be easily operated by moving clamp lever 498 about pivot 485 between the engaged and disengaged positions.

While the present teachings have been shown and explained with reference to specific illustrations, it should be appreciated that variations and deviations to the illustrations shown can be employed without departing from the spirit and scope of the present teachings. For example, it should be appreciated that the various features disclosed in base assemblies 24, 124, 224, 324, 424 can be intermixed with one another to provide a base assembly having desired features. Additionally, each of the base assemblies according to the present teachings can include more or less than the features disclosed herein. Moreover, the specific shapes, dimensions, and appearance of the various components can differ from that shown while still providing the advantages and benefits of the present teachings. Thus, the figures used to illustrate the present teachings are merely exemplary in nature and deviations from these illustrations are intended to be within the spirit and scope of the present teachings.

LIST OF REFERENCE NUMBERS

20 power tool/router
22 motor unit
14 base assembly
26 adjustment ring
30 head portion
32 cylindrical portion
33 cord
34 switch
36 spindle
38 collet
40 threads
41 threads
42 axial slot
44 projecting feature
46 head portion
48 stem portion
49 openings
50 housing
51 section
52 foot
53 aperture
54 upper portion
55 gap
56 clamp assembly
57 slot
58 interior surface
60 recess
62 retaining ring
64 cylindrical portion
66 lip
68 depth-indicator ring
70 top surface
74 top surface
76 levers
78 tang
80 upper end
82 pivot
83 sloping surface
84 sloping surface
86 housing
87 top surface
88 annular recess
89 chamfer
90 annular recess
91 chamfer
92 depth-indicator ring
94 adjustment ring
124 base assembly
144 projecting feature
150 housing
160 recess
161 shoulder
162 retaining ring
166 lip
170 top surface
172 axial retaining feature
173 lip
224 base assembly
262 retaining ring
273 lip
274 top surface
275 inner wall
284 sloping surface
324 base assembly
350 housing
360 recess
361 groove
362 retaining ring
372 axial retaining feature
424 base assembly
450 housing
451 opening
454 upper portion
485 pivot
493 clamping assembly
495 clamp spring
495*a* end
495*b* end
497 pivot pin
498 clamp lever
499 clamp pad

What is claimed is:

1. A portable router base assembly comprising:

a housing having a foot, an upper portion, and an interior defined at least in part by an interior surface, said upper portion including an upper surface, said housing interior configured to receive a portion of a portable router, and said interior surface including a radially outwardly extending annular recess adjacent said upper surface; and a retaining ring including an interior, a generally cylindrical portion, and a top surface, said top surface at least partially defining an opening to said retaining ring interior, said cylindrical portion at least partially disposed in said annular recess of said housing and fixedly secured thereto so as to be non-removable therefrom, and said retaining ring interior configured to receive said portion of said portable router through said opening;

wherein said retaining ring includes a lip portion adjacent said top surface, said lip portion having a radially outwardly extending surface that engages with a retaining lever on said portable router for releasably securing said portable router to said retaining ring.

2. The base assembly of claim 1, wherein said annular recess includes a radially inwardly extending upper shoulder, and said cylindrical portion includes at least one axial retaining feature, and said at least one axial retaining feature has a radially outwardly extending tab that engages with said upper shoulder to fixedly secure said retaining ring to said housing.

3. The base assembly of claim 1, wherein said cylindrical portion is press fit into said annular recess thereby fixedly securing said retaining ring to said housing.

4. The base assembly of claim 1, wherein said annular recess includes an annular groove that extends radially outwardly, and said cylindrical portion includes an axial retaining feature having a radially outwardly extending projection that engages with said annular groove and inhibits removal of said retaining ring from said housing.

5. The base assembly of claim 1, wherein said retaining ring top surface supports said portable router when disposed in said interiors of said retaining ring and said housing.

6. The base assembly of claim 1, wherein said retaining ring is a one-piece component and includes an integral anti-rotation projecting feature that prevents rotation of said portable router relative to said retaining ring and said housing.

7. The base assembly of claim 1, wherein said housing is a first material, said retaining ring is a second material, and said first material is different than said second material.

8. The base assembly of claim 1, wherein said cylindrical portion of said retaining ring has a first radial thickness, said upper portion of said housing has a second radial thickness, and said first radial thickness is less than said second radial thickness.

9. The base assembly of claim 1, further comprising a clamping assembly coupled to said housing and operable to secure said portable router to said housing.

10. A power tool assembly comprising:

a portable router having a head portion, a generally cylindrical portion, a motor unit, and a spindle operable to receive a working tool;

a fixed-base assembly operable to receive said portable router and support said portable router in a desired axial position relative to a working surface, said fixed-base assembly including:

a housing having a foot, an upper portion, and an interior defined at least in part by an interior surface, said upper portion including an upper surface, said housing interior receiving said cylindrical portion of said portable router, and said interior surface including a radially outwardly extending annular recess adjacent said upper surface; and a retaining ring including an interior, a generally cylindrical portion, and a top surface, said top surface at least partially defining an opening to said retaining ring interior, said retaining ring cylindrical portion at least partially disposed in said annular recess of said housing and fixedly secured thereto so as to be non-removable therefrom, and said retaining ring interior configured to receive said cylindrical portion of said portable router through said opening;

wherein said retaining ring cylindrical portion includes at least one axial retaining feature, and said at least one axial retaining feature has a radially outwardly extending tab that engages with said annular recess in said housing to fixedly secure said retaining ring to said housing.

11. The power tool assembly of claim 10, wherein said retaining ring cylindrical portion is press fit into said annular recess thereby fixedly securing said retaining ring to said housing.

12. The power tool assembly of claim 10, wherein said annular recess includes an annular groove that extends radially outwardly, and said cylindrical portion includes an axial retaining feature having a radially outwardly extending projection that engages with said annular groove and inhibits removal of said retaining ring from said housing.

13. The power tool assembly of claim 10, wherein said retaining ring top surface supports said portable router when disposed in said interiors of said retaining ring and said housing.

14. The power tool assembly of claim 10, wherein said retaining ring is a one-piece component and includes an integral anti-rotation projecting feature that engages with said portable router and prevents rotation of said portable router relative to said fixed-base assembly.

15. The power tool assembly of claim 10, wherein said housing is a first material, said retaining ring is a second material, and said second material is different from and harder than said first material.

16. The power tool assembly of claim 10, wherein said cylindrical portion of said retaining ring has a first radial thickness, said upper portion of said housing has a second radial thickness, and said first radial thickness is less than said second radial thickness.

17. The power tool assembly of claim 10, further comprising a clamping assembly coupled to said housing and operable to secure said portable router to said fixed-base assembly.

18. A power tool assembly comprising:

a portable router having a head portion, a generally cylindrical portion, a motor unit, and a spindle operable to receive a working tool;

a fixed-base assembly operable to receive said portable router and support said portable router in a desired axial position relative to a working surface, said fixed-base assembly including:

a housing having a foot, an upper portion, and an interior defined at least in part by an interior surface, said upper portion including an upper surface, said housing interior receiving said cylindrical portion of said portable router, and said interior surface including a radially outwardly extending annular recess adjacent said upper surface; and a retaining ring including an interior, a generally cylindrical portion, and a top surface, said top surface at least partially defining an opening to said retaining ring interior, said retaining ring cylindrical portion at least partially disposed in said annular recess of said housing, and said retaining ring interior configured to receive said cylindrical portion of said portable router through said opening, wherein said portable router includes an adjustment ring that rotates relative to said cylindrical portion of said portable router to adjust an axial position of said portable router relative to said fixed-base assembly, said retaining ring includes a lip portion adjacent said top surface, said lip portion having a radially outwardly extending surface, and said adjustment ring includes at least one retaining lever with a tang that engages with said lip to releasably secure said portable router to said retaining ring.

19. A router base assembly for removably receiving a motor unit having a generally cylindrical lower portion, the router base assembly comprising:

a housing having a lower foot portion and an upper generally cylindrical portion having a generally cylindrical interior for receiving the lower portion of the motor unit, and a retaining ring having a lower portion and a generally cylindrical upper portion defining a top surface, wherein said lower portion of said retaining ring is permanently joined to the upper generally cylindrical portion of said housing so that the router base assembly comprises a unitary assembly, and further wherein said retaining ring includes a radially displaced segment in said upper portion that engages with a latch member on said motor unit for releasably securing said motor unit to said retaining ring.

20. The router base assembly of claim 19, wherein the top surface of said retaining ring extends above the upper generally cylindrical port1on of the housing.

21. The router base assembly of claim 20, wherein said housing is a first material and said retaining ring is a second material that is different from and harder than said first material.

22. The router base assembly of claim 21, wherein said retaining ring includes a radially outwardly extending lip portion adjacent said top surface that is configured to engage each latch member on the motor unit for releasably securing the motor unit to said router base assembly.

23. The router base assembly of claim 21, wherein said top surface of said retaining ring comprises an annular surface configured to axially support the motor unit when disposed in said router base assembly.

24. The router base assembly of claim 23, wherein the motor unit includes a depth adjustment ring threadably coupled to the generally cylindrical lower portion of the motor unit, and further wherein the depth adjustment ring rests upon said top annular surface of said retaining ring.

25. The router base assembly of claim 19, wherein the generally cylindrical interior of said upper portion of said housing is defined by a substantially cylindrical interior surface having a radially enlarged recess formed therein adjacent an upper end of said housing.

26. The router base assembly of claim 25, wherein said retaining ring is permanently joined to said housing by fitting at least part of said lower portion of said retaining ring into said recess of said housing.

* * * * *